United States Patent [19]

Caldwell

[11] 4,099,477

[45] Jul. 11, 1978

[54] ENGINE POWERED WATER CRAFT

[76] Inventor: David W. Caldwell, Plant City, Fla. 33566

[21] Appl. No.: 705,090

[22] Filed: Jul. 14, 1976

[51] Int. Cl.[2] ..... B63B 1/26

[52] U.S. Cl. ..... 114/281; 114/61; 114/163; 114/291

[58] Field of Search ..... 114/66.5 R, 66.5 H, 114/66.5 S, 66.5 P, 61, 126, 141, 162, 163, 164, 271, 272, 273, 274, 280, 281, 291; 115/34 R, 17, 70

[56] References Cited

U.S. PATENT DOCUMENTS

| | | | |
|---|---|---|---|
| 2,099,492 | 11/1937 | Luders | 114/66.5 R |
| 2,914,014 | 11/1959 | Carl et al. | 114/281 |
| 3,078,819 | 2/1963 | Kiss | 114/61 |
| 3,149,600 | 9/1964 | Traksel | 114/66.5 H |
| 3,498,247 | 3/1970 | Handler | 114/274 |
| 3,584,590 | 6/1971 | Rings | 114/61 X |
| 3,648,640 | 3/1972 | Granger | 114/273 |
| 3,768,429 | 10/1973 | Greer | 114/61 X |
| 3,789,789 | 2/1974 | Cleary | 114/66.5 H |
| 3,952,678 | 4/1976 | Weston | 114/272 |

*Primary Examiner*—Trygve M. Blix
*Assistant Examiner*—Sherman D. Basinger
*Attorney, Agent, or Firm*—Arthur W. Fisher, III

[57] ABSTRACT

An engine powered water craft comprising a hull including a pair of spaced apart hull elements extending rearwardly therefrom configured to support the craft on the water in combination with a twin rudder system for directional control. The hull further comprises an upper and lower foil extending between the hull elements. The twin rudder system comprises a pair of rudders each including a substantially vertical rudder element having a super cavitating foil element attached to the outer side thereof. The super cavitating foil element comprises a knife-like member extending upwardly at an angle from the vertical rudder element. To counteract engine torque, the rudders are vertically offset relative to each other.

13 Claims, 5 Drawing Figures

ENGINE POWERED WATER CRAFT

BACKGROUND OF THE INVENTION

1. Field of the Invention

An engine powered twin-hull water craft comprising a hull having a pair of spaced apart hull elements configured to support the craft on the water in combination with a twin rudder system for directional control.

2. Description of the Prior Art

A number of twin hulled, twin rudder water craft have been developed for high speed operation. Often such vessels include rudders which point the craft in the desired direction by inducing a yaw. Unfortunately the side forces associated with yaw cause the water craft to skid when in a turn. This is particularly undesirable for high speed water craft.

Other craft include means of steering by controlled banking by tilting the craft. This is radically different from the more common watercraft. Thus instead of rotating the watercraft about a vertical axis it is titled about the longitudinal axis. For example the water craft may include steering means comprising a pair of steering control members mounted beneath the craft symmetrical to the longitudinal axis and disposed in planes inclined to the vertical.

Moreover the craft may comprise a pair of laterally spaced hull structures. Each hull structure having inner and outer side surfaces and a bottom surface wherein the inner surface presents a downwardly and inwardly sloping face with means for steering the craft. The steering means comprises a control member mounted beneath each hull structure in a plane inclined to the vertical whereby the inclined planes intersect at a point above the control members so as to include an acute angle therebetween.

SUMMARY OF THE INVENTION

The present invention relates to an engine powered water craft. More specifically, the water craft comprises a hull and a twin rudder system operatively mounted on the rear portion thereof.

The hull comprises a pair of spaced apart hull elements having an upper and lower foil extending therebetween. Each hull element comprises a first member to support the craft on the water and a second member extending between the first member and the upper foil. The upper foil comprise a convex surface. The hull elements extend forward of the thin bow to form a pair of sharp leading bow points.

The twin rudder system comprises a pair of rudder, each comprising a substantially vertical rudder element having a super cavitating foil element attached to the outer side thereof. Each super cavitating foil element comprises a knife-like member extending upwardly at an angle from the substantially vertical rudder element. The rudders are counted on the rear portion of the hull by a mounting plate having swivel plate rotatably attached thereto by mounting pin. The rudders are interconnected to move in unison by a rudder interconnect rod coupled therebetween. At least one directional control interconnect element is coupled to a steering mechanism to the rudder system. To counteract the engine torque through the screw, the rudders are vertically offset relative to each other. In addition, each vertical rudder element is rotatably coupled to the hull through the swivel plate and mounting plate. As a result, if the rudders hit a rigid or hard object, they will rotate upwardly to prevent damage.

In operation, the engine powered water craft is propelled through the water by a screw or propeller. At operating speed, the air flowing under the lower foil lifts the hull upper to ride on the first members. Simultaneously the air flows over the upper foil preventing the hull from rotating out of the water. The rear portion of the hull is supported on the surface of the water by the super cavitating foil elements and super cavitating propeller. Direction is controlled by turning the rudder in unison by operation of the steering mechanism. Since the rudders are offset vertically relative to each other, the screw torque tending to turn or yaw the hull is overcome.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
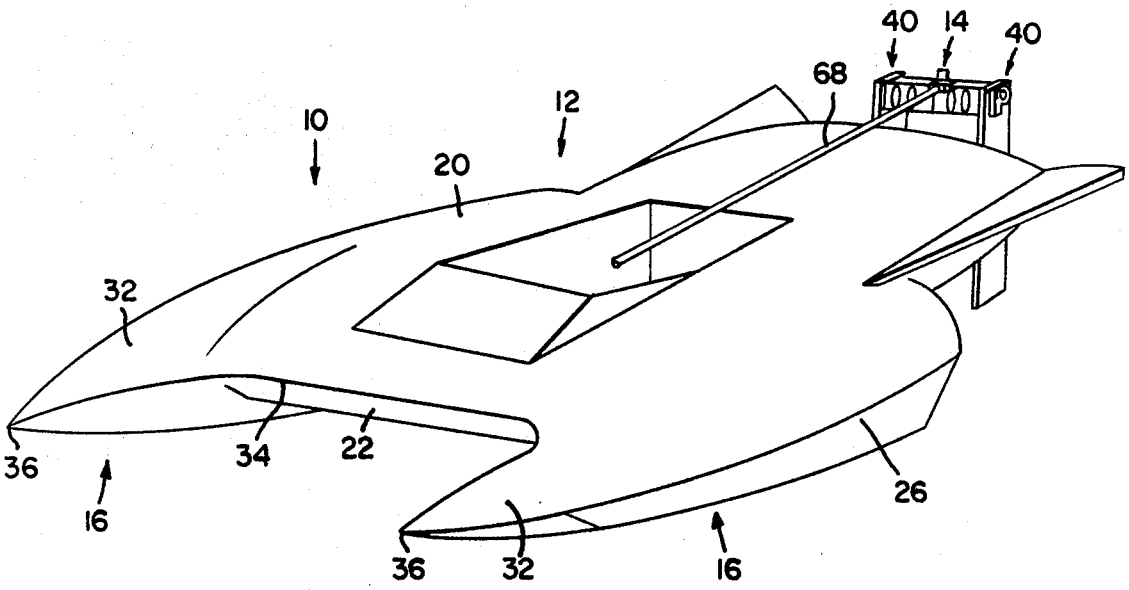
FIG. 1 is a top elevation view of an engine powered Water Craft.

As shown in FIG. 1, the water craft generally indicated as 10 comprises a hull generally indicated as 12 and a twin rudder system generally indicated as 14 operatively mounted on the rear portion thereof.

Figure 2:
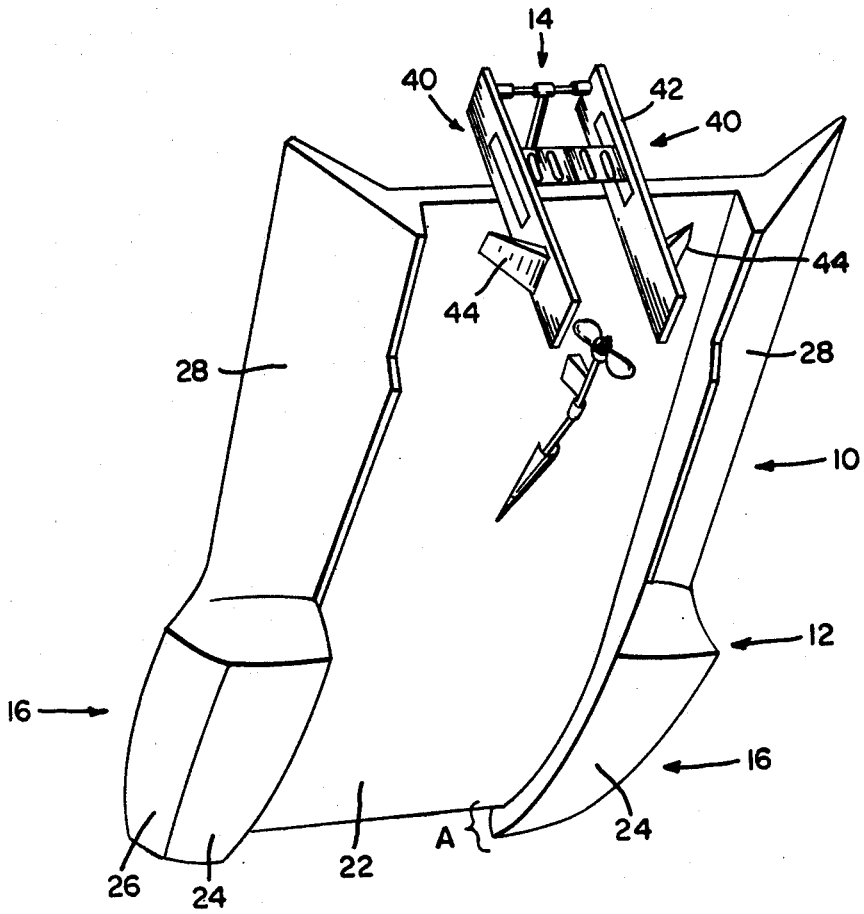
FIG. 2 is a bottom elevated view of an engine powered Water Craft.

As best shown in FIGS. 1 and 2, the hull 12 comprises a pair of spaced apart hull elements each generally indicated as 16. The hull 12 includes an upper and lower foil 20 and 22 respectively extending between hull elements 16. Each hull element 16 comprises a first member 24 to support the craft 10 on the water and a second member 26 extending between the first member 24 and the upper foil 20. Each hull element 20 and 22 further includes a third member 28 extending rearwardly from the first and second member 24 and 26 between the upper and lower foils 20 and 22. The upper foil 20 comprises a convex surface. The leading edge of the upper and lower foils 20 and 22 intersect rearward of the forward portion 32 of the hull elements 16 to form a thin bow 34. As shown, the hull elements 16 extend forward of the thin bow 34 to form a pair of sharp leading bow points 36.

Figure 4:
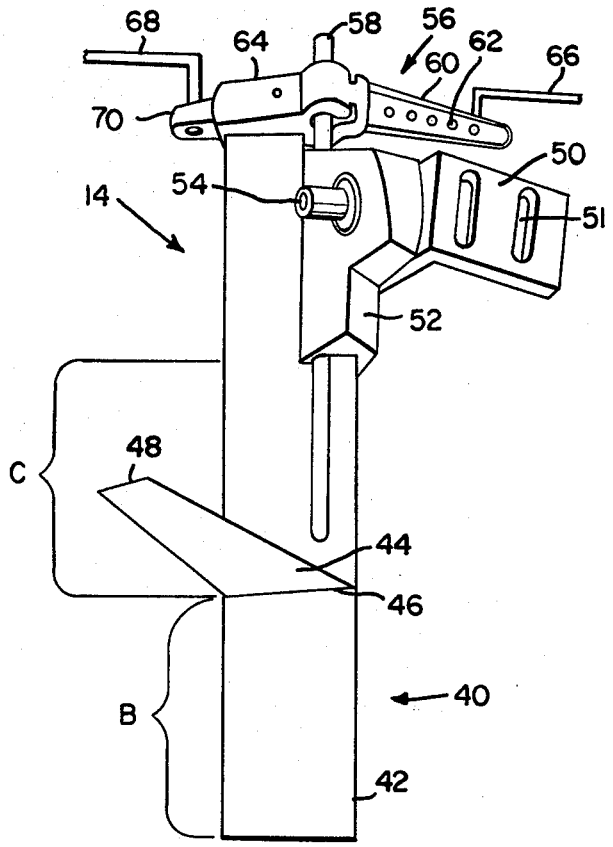
FIG. 4 is a detailed view of a rudder.
Figure 5:
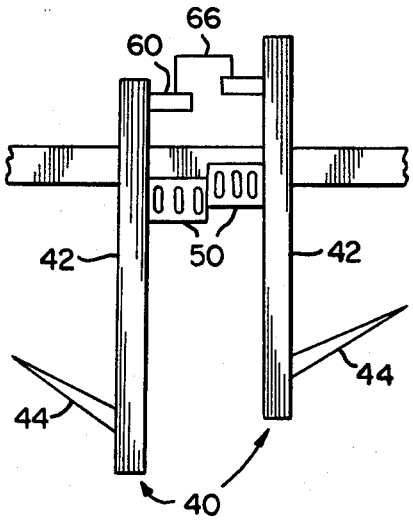
FIG. 5 is a rear schematic view of the rudder system.

As shown in FIG. 4, the twin rudder system 14 comprises a pair of rudders each generally indicated as 40. Each rudder 40 comprises a substantially vertical rudder element 42 having a super cavitating foil element 44 attached to the outer side thereof. Each super cavitating foil element 44 comprises a knifelike member extending upwardly at an angle from the substantially vertical rudder elements 42. The inner edge 46 of the super cavitating foil element 44 is wider than the outer edge 48 thereof. Each rudder 40 is mounted on the rear portion of the hull 12 by mounting plate 50 having a swivel plate 52 rotatably attached thereto by mounting pin 54. A directional control member 56 is attached to the upper portion of rudder element 42 and interconnected to the swivel plate 52 by interconnecting rod 58. The directional control member 56 comprises a rudder interconnect element 60 having a plurality of apertures 62 formed therein and a directional control interconnect element 64. The rudders 40 are interconnected to move in unison by a rudder interconnect rod 66 coupled between apertures 62 of opposite rudder interconnect element 60. At least one directional control interconnect element 64 is coupled to a steering mechanism (not shown) by a directional control rod 68 to aperture 70 formed therein. To counteract the engine torque through the screw, the rudders 40 are vertically offset relative to each other. To permit vertical adjustment the mounting plates 50 include vertical slots 51 to provide for adjustment. In addition, each vertical rudder element 42 is rotatably coupled to the hull 12 through the swivel plate 52 and mounting plate 50.

It should be noted that the vertical distance between the trailing edge of the first member 24 and the lower foil 22 (A), between the lower edge of rudder elements 42 and the trailing edge super cavitating foil 44 (B) and between the trailing edge of super cavitating foil 44 and swivel plate 52 (C) are substantially equal. Further the super cavitating foils 44 are inclined upwardly relative to the horizontal plane to induce the hydro-dynamic lift.

Figure 3:
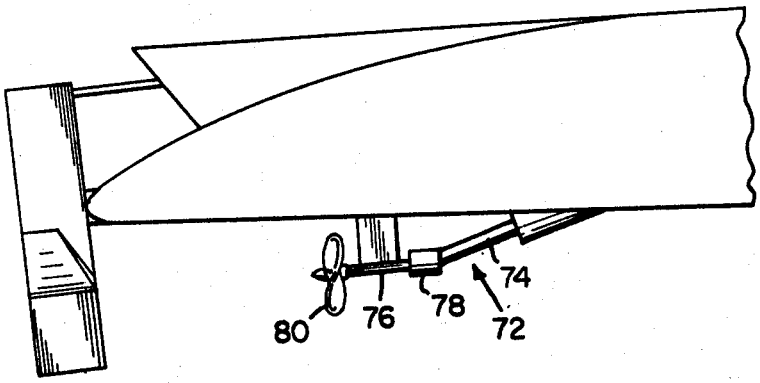
FIG. 3 is a partial side view of an engine powered Water Craft.

As best shown in FIG. 3, a drive means generally indicated as 72 comprises a drive shaft 74 coupled to substantially horizontal strut 76 parallel to the lower foil 22 through a universal means 78. Attached to the rear portion of strut 76 is a super cavitating propeller 80.

In operation, the engine powered water craft 10 is propelled through the water by the screw or propeller 78 coupled to a power plant (not shown). At operating speed, the hull 12 is lifted upwardly hydro-dynamically to ride on the first members 24. Simultaneously the air flows over the upper foil 20 preventing the hull 12 from rotating out of the water. The rear portion of the hull 12 is lifted out of the water such that the super cavitating foil elements 44 ride on the surface of the water at the intersection of the super cavitating foil elements 44 and the substantially vertical rudder elements 42. Direction is controlled by turning the rudders 40 in unison by operation of the steering mechanism (not shown). Since the rudders 40 are offset vertically relative to each other and the rear portion of the craft 10 rides on the air cushion between the foil elements 44 and rudder elements 42, the screw torque tending to turn or yaw the hull 12 is overcome. In the event either rudder 40 strikes a rigid or hard object, the rudders 40 rotate with swivel plate 52 about mounting pin 54 to prevent damage thereto.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. An engine powered water craft comprising a hull including a pair of spaced apart hull elements configured to support said craft on the water in combination with a twin rudder system for directional control, said hull further comprising an upper and lower foil extending between said hull elements, said upper and lower foil intersecting rearward of the forward portion of said hull elements to cooperatively form a thin bow, said twin rudder system comprising a pair of rudders each including a substantially vertical rudder element having a super cavitating foil element attached to the outer side thereof, each said super cavitating foil comprising a knife-like member extending in an angle from said substantially vertical rudder elements, said super cavitating foil elements configured to engage the surface of the water to support the rear portion of said water craft on the water at the intersection of said super cavitating foil elements and said substantially vertical rudder elements.

2. The water craft of claim 1 wherein each said hull element comprises a first member to support said water craft on the water and a second member extending between said first member and said upper foil.

3. The water craft of claim 2 wherein each said hull element further includes a third member extending rearwardly from said first and second members between said upper and lower foils.

4. The water craft of claim 3 further including a swivel plate to couple said rudder elements to said hull wherein the vertical distance between the trailing edge of said first member and said lower foil, between the lower edge of said rudder elements and the trailing edge of said uper cavitating foil and between the trailing edge of said foil and said swivel plate are substantially equal.

5. The water craft of claim 4 wherein said super cavitating foils are inclined upwardly relative to the horizontal plane to induce the hydro-dynamic lift.

6. The water craft of claim 1 wherein said upper foil comprises a convex surface.

7. The water craft of claim 1 wherein said hull elements extend forward of said thin bow to form a pair of sharp leading bow points.

8. The water craft of claim 1 wherein the inner edge of each said super cavitating foil is wider than the outer edge thereof.

9. The water craft of claim 8 wherein said rudders are offset vertically relative to each other to counteract torque to said water craft.

10. The water craft of claim 9 wherein said rudders are operatively interconnected by a rudder interconnect element to move in unison.

11. The water craft of claim 1 further includes a a drive means comprising a drive shaft coupled to a substantially horizontal strut substantially parallel to said lower foil through a universal means.

12. A super cavitating twin rudder system comprising a pair of rudders, each said rudder comprising a substantially vertical rudder element having a super cavitating foil element attached to the outerside, said rudders being vertically offset relative to each other to counteract engine torque, each said super cavitating foil element comprising a knife-like member extending upwardly at an angle from said substantially vertical rudder elements.

13. The super cavitating twin rudder system of claim 12 wherein the inner edge of each said super cavitating foil element is wider than the outer edge thereof.

* * * * *